US005537750A

United States Patent [19]

Seber et al.

[11] Patent Number: 5,537,750

[45] Date of Patent: Jul. 23, 1996

[54] FOLDING KNIFE WITH DOUBLE SIDE LOCK MECHANISM

[75] Inventors: Brett P. Seber, Escondido; Roy L. Helton, Jr., San Diego, both of Calif.

[73] Assignee: Buck Knives, Inc., El Cajon, Calif.

[21] Appl. No.: 440,788

[22] Filed: May 15, 1995

Related U.S. Application Data

[63] Continuation of Ser. No. 330,092, Oct. 25, 1994, abandoned, which is a continuation of Ser. No. 138,703, Oct. 18, 1993, abandoned.

[51] Int. Cl.[6] ..... B26B 1/04; F41B 13/08

[52] U.S. Cl. ..... 30/161; 7/118; 30/160

[58] Field of Search ..... 30/160, 161, 329, 30/331; 7/118–120

[56] References Cited

U.S. PATENT DOCUMENTS

| | | | |
|---|---|---|---|
| 237,138 | 2/1881 | Slayton . | |
| 280,150 | 6/1883 | Dubois . | |
| 689,513 | 12/1901 | Papendell . | |
| 825,093 | 7/1906 | Watson | 30/161 |
| 1,510,420 | 9/1924 | Sherman . | |
| 1,545,542 | 7/1925 | Albrecht et al. . | |
| 1,828,121 | 10/1931 | Adam et al. . | |
| 2,718,695 | 9/1955 | Elsener . | |
| 2,809,384 | 10/1957 | Kayser . | |
| 2,896,290 | 7/1959 | Salm et al. . | |
| 3,415,250 | 12/1968 | Peterson . | |
| 4,078,272 | 3/1978 | Mahon, III . | |
| 4,805,303 | 2/1989 | Gibbs . | |
| 4,856,132 | 8/1989 | Burns et al. . | |
| 4,896,424 | 1/1990 | Walker . | |
| 4,947,552 | 8/1990 | Barnes | 30/161 |
| 4,985,998 | 1/1991 | Howard . | |
| 5,009,008 | 4/1991 | Yablonovitch . | |
| 5,044,079 | 9/1991 | Gibbs | 30/160 |

FOREIGN PATENT DOCUMENTS

| | | |
|---|---|---|
| 117410 | 7/1918 | United Kingdom . |

OTHER PUBLICATIONS

Advertisement for Edgeco Tactical One Hander Knife, *Shooting Times*, Dec. 1993, p. 26.

*Primary Examiner*—Douglas D. Watts
*Attorney, Agent, or Firm*—Gregory Garmong

[57] ABSTRACT

A folding knife has first and second blades pivotably mounted about a common pivot pin to move between their respective open and closed positions. Preferably, the two blades pivot in opposite directions about the pivot pin. A side lock plate is positioned between the first blade and the second blade. The side lock plate includes a first finger biased toward the first blade to engage the first blade when the first blade is in its open position, and a second finger biased toward the second blade to engage the second blade when the second blade is in its open position. The fingers can be independently depressed to unlock the blades and permit them to be closed.

19 Claims, 5 Drawing Sheets

FOLDING KNIFE WITH DOUBLE SIDE LOCK MECHANISM

This application is a continuation of application Ser. No. 08/330,092, filed Oct. 25, 1994, now abandoned which was a continuation of Ser. No. 08/138,703 Oct. 18, 1993 now abandoned.

BACKGROUND OF THE INVENTION

This invention relates to a knife with folding blades, and, more particularly, to such a knife having a simplified locking mechanism.

Knives are commonly available with either fixed blades or extendable blades. The fixed blade knife, whose blade is permanently fixed in the extended position, is popular with outdoorsmen because it is strong and can be provided with features particularly useful in hunting, fishing, and other outdoor activities. The extendable blade knife, on the other hand, can be provided with multiple blades and many more features than the fixed blade knife. The extendable blade knife is also more compact than the fixed blade knife for carrying and storage. The most popular type of extendable blade knife is the folding blade knife, and the present invention relates to such folding blade knives.

The folding blade knife has a knife body and at least one pivot pin. The blade or blades are pivotably mounted to the pivot pin or pivot pins. The knife has a retention mechanism to hold the blades in the closed position, within the knife body, until the user of the knife selects one of the blades for use. The selected blade is controllably extended by rotating it about its pivot pin to the open position.

A locking mechanism may be provided to lock the selected blade in the open position in a manner that permits later selective unlocking of the blade and pivoting it back to the closed position. Alternatively, there may be provided no locking mechanism for the extended blade, so that the user holds the blade in position during use.

A number of locking mechanisms are available for use with opened blades of folding knives. In one approach, the mechanism includes a spring bearing on the blade to create an overcenter arrangement which retains the blade in the closed position until forced open against the spring force by the user and also holds the blade in the open position until forced closed. The spring mechanism creates a force that tends to return the blade to the closed position once the overcenter position is reached. There may be a positive lock of the blade in the extended position, such as in the well known lockback configuration. In another approach, a detent structure holds the blade in the closed position, and a lock is provided to lock the blade in the open position. In this case, there is no spring force tending to close the blade.

In yet another approach, a side lock plate is placed laterally adjacent to the blade to be locked. The side lock plate includes a finger that is biassed toward the blade to be locked. The blade is normally held closed by a detent mechanism. When the blade is opened, the finger locks the blade in the open position. The user later selectively unlocks the blade so that it can be folded closed by depressing the finger and disengaging it from the blade.

Various other locks and combinations of closed-position retention mechanisms and open-position locks are known. More complex locking mechanisms have been devised, but these complex mechanisms are costly to produce and more prone to failure than a relatively simple locking mechanism.

These various retention and locking mechanisms are all operable and useful in various situations. However, each has its disadvantages. The proper operation of the spring closure requires the use of both hands to open and close the knife, a distinct disadvantage for some users. (Some users attempt to open such a spring closure by employing another part of the body, such as the thigh, to support the blade during opening or closing in order to use only one hand—this has resulting in cutting of the user in some cases.) A separate positive lock typically adds weight, cost, and complexity to the knife. Also, a separate locking mechanism is typically required for each blade, so that the knife becomes complex, heavy, and unwieldy when there is a provision for locking more than one blade in its open position. The result in that in most instances a knife will have only a single blade where there is to be a positive lock for the open blade.

There is a need for an improved retention and locking mechanism for folding knives. The locking mechanism should be operable with two blades that are to be locked in the open position and releasably closed. The locking mechanism should permit one-handed operation by the user of the knife. Desirably, the locking mechanism would be inexpensive and simple in construction. The present invention fulfills this need, and further provides related advantages.

SUMMARY OF THE INVENTION

The present invention provides a knife with at least two folding blades. The blade to be opened is selected by the user and opened from its closed position with one hand of the user. After opening, the selected blade is positively locked in the open position. To return the blade to the closed position, the user disengages the lock and rotates the blade to the closed position, again with one hand. The ability to completely select the blade to be used, open the blade, unlock the blade, and close the blade, all with only one hand and leaving the other hand free, is a major advantage for some knife users such as law enforcement officers and emergency rescue personnel. The knife user can accomplish all knife opening, closing, and use functions of both blades with one hand, while using the other hand to hold another tool or control the movement of a person. The easy one handed operation also improves the safety of the knife use, as there is no need to resort to unsafe techniques to open the blades.

In accordance with the invention, a folding knife comprises a first blade pivotably mounted to move between a first blade open position and a first blade closed position, and a second blade pivotably mounted to move between a second blade open position and a second blade closed position. The knife further includes side lock means, positioned between the first blade and the second blade, for permitting independently controllable opening and closing of the first and second blades. The side lock means includes first blade side lock means for releasably locking the first blade in a first blade open position, and second blade side lock means for releasably locking the second blade in a second blade open position. There may be provided additional blades that can be moved between their open and closed positions, and these additional blades may have locking features.

Desirably, the knife includes a common pivot pin about which the first blade and the second blade pivot. The first blade pivots about the common pivot pin from the first blade closed position to the first blade open position in a first pivoting direction. The second blade pivots about the common pivot pin from the second blade closed position to the second blade open position in a second pivoting direction, opposite to the first pivoting direction. Consequently, the first blade unfolds from the knife top, and the second blade unfolds from the knife bottom.

In one embodiment, the side lock plate includes a first finger sprung or bent toward the first blade and a second finger sprung or bent toward the second blade. The first finger engages the first blade when the first blade is in the first blade open position, and the second finger engages the second blade when the second blade is in the second blade open position. To unlock the blade and move it to its closed position, the respective finger is depressed against the biasing force of the sprung metal so that the blade clears the finger and can be pivoted to the closed position.

This knife utilizes few parts, and is therefore relatively simple and inexpensive to construct. The blades lock in their open positions, with a strong, reliable locking structure. The knife of the invention may therefore be used in a wide range of applications. After use, the open blade can be unlocked readily with one hand and closed. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
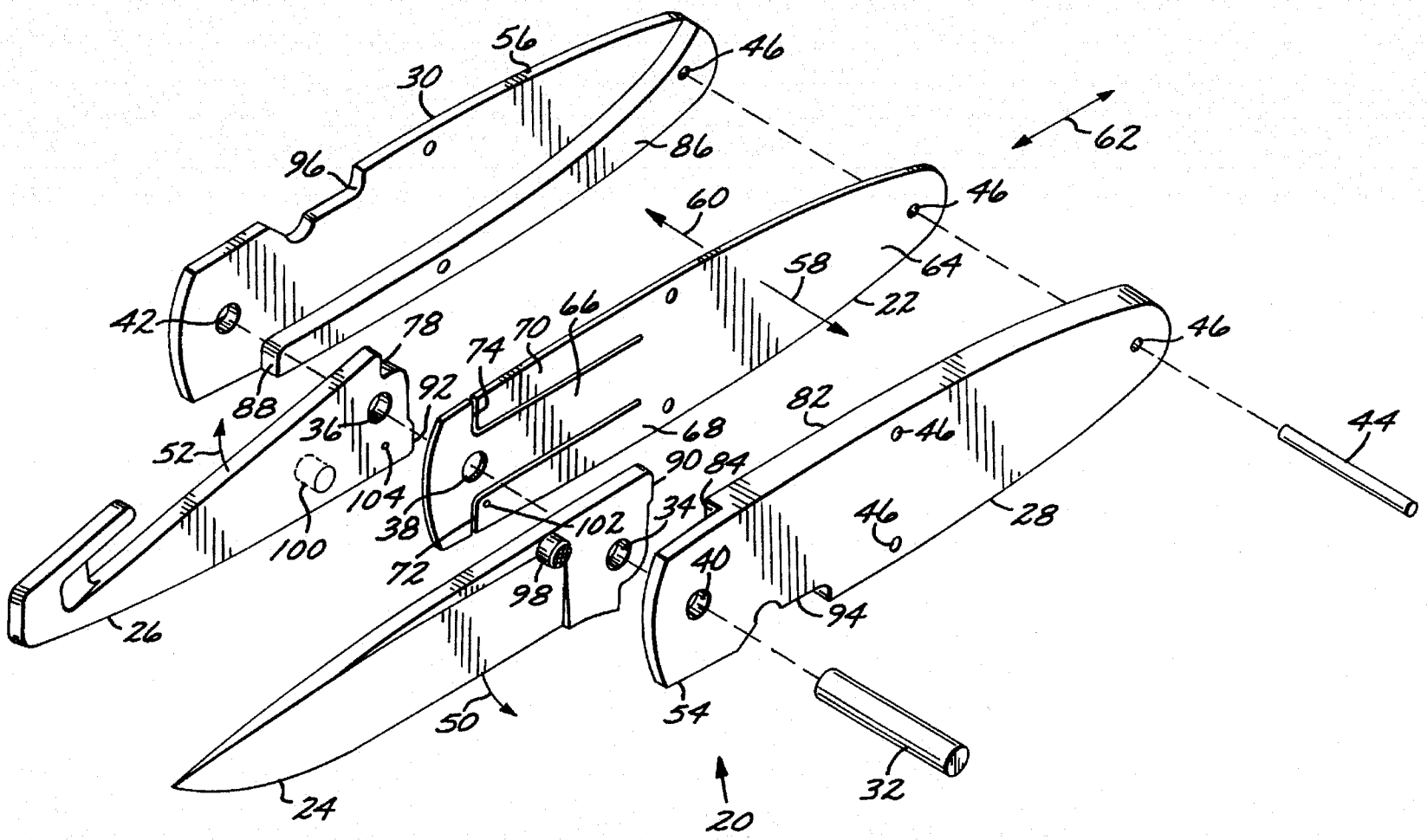
FIG. 1 is a perspective exploded view of one embodiment of the knife of the invention.

A folding knife 20 according to a preferred embodiment of the invention is shown in FIGS. 1–5. (The term "folding knife" is commonly used to describe knives wherein the blades are contained within the body of the knife when closed, and are pivoted about a pivot pin to an opened position.) The knife 20 utilizes a side lock plate 22 operable to lock two blades, a first blade 24 and a second blade 26. The side lock plate and the blades are preferably made of steel, and most preferably a stainless steel of any type known in the art. In the figures, the first blade 24 is depicted as a conventional single-sided cutting blade, and the second blade 26 is depicted as a hooked blade that may be used by law enforcement and emergency personnel to cut fabric webs such as a seat belt to free a trapped person. As used herein, the term "blade" includes conventional single-edged cutting blades and other types of implements known for use in a folding knife format. Such implements can include, for example, hunting blades, skinning blades, filleting blades, screwdrivers, scissors, pliers, saws, can openers, gut hooks, awls, and the like, in addition to conventional single-edged cutting blades. The present invention is not restricted as to the types of blades used, and is operable with all types of blades known to the inventors.

The side lock plate 22 is positioned between and parallel to the pivoting planes of the two blades 24 and 26. A first sidepiece 28 overlies and is positioned outside of the first blade 24, so that the first blade 24 is disposed between the first sidepiece 28 and the side lock plate 22. A second sidepiece 30 overlies and is positioned outside of the second blade 26, so that the second blade 26 is disposed between the second sidepiece 30 and the side lock plate 22. The sidepieces are preferably made by injection molding a thermoforming plastic using conventional injection molding technology.

A common pivot pin 32 extends through aligned bores 34 and 26 in the blades 24 and 26, respectively, so that the blades pivot about that pivot pin 32. As a convenience in construction and assembly, the pivot pin 32 typically extends through commonly aligned bores 38 40, and 42 in the side lock plate 22, the first sidepiece 28, and the second sidepiece 30, respectively. The use of a single pivot pin for both blades 24 and 26 permits the blades to be pivoted and deployed to their open positions at different times, without turning the knife 20 end-for-end, as in some other types of folding knives.

The knife 20 of the invention is formed as the separate elements 22, 24, 25, 38, 30, and 32. The side lock plate 22 and the sidepieces 28 and 30 are provided with commonly aligned rivet holes 44. To assemble the knife 20, the elements 22, 24, 26, 28, and 30 are stacked in the proper order into an assembly jig. The pivot pin 32 is placed through the commonly aligned bores 34, 35, 38, 40, and 42. Rivets 44 (or screws) are fastened through the rivet holes 45 (only one of the rivets 44 is shown to avoid clutter in the drawings). The pivot pin 32 also acts as a rivet, as its ends are upset during assembly.

Figure 6:
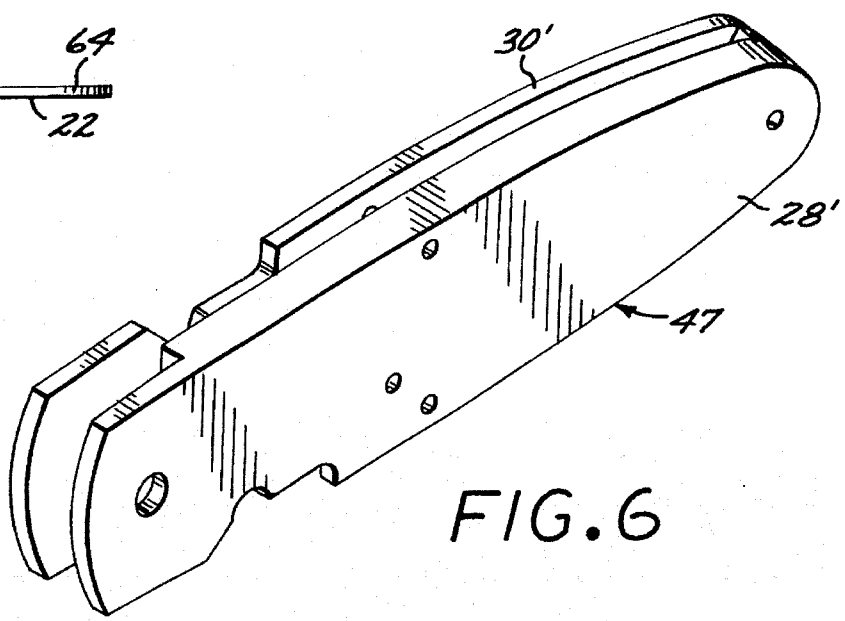
FIG. 6 is a perspective view of an integral sidepiece structure.

Alternatively, the sidepieces 28 and 30 can be formed as a single molded sidepiece unit 47, shown in FIG. 6. Such a sidepiece unit 47 can be conveniently fabricated by plastic injection molding, for example. In this case, a bridge is formed between side piece segments 28' and 30' to hold the side piece segments in their proper positions. The other elements 22, 24, 25, 32, and 44 are assembled to this single sidepiece unit 47 in the manner described.

Returning to the embodiment of FIGS. 1–5, when assembled the integral unit formed of the side lock plate 22 and the sidepieces 28 and 30 is termed a body 48 of the knife. The blades 24 and 26 fold into the body 48 in their respective closed positions (shown in FIG. 2 for the first blade) and fold out of the body 48 to their respective open positions (shown in FIG. 3 for the first blade). The first blade 24 and the second blade 26 pivot in respective planes that are parallel to each other and to the plane of the side lock plate 22 as the blades are moved between their respective open and closed positions.

A desirable feature of the present knife 20 is that the blades 24 and 26 are contained entirely within the body 48 when they are in the closed position. The locking structure is also contained entirely within the profile or outline of the body 48. Only the small flick projections, to be discussed subsequently, may optionally extend slightly above the smooth sides, top, and bottom of the knife. Consequently, there are no (or very minor) projections on the knife 20 that can snag on clothing or injure the user of the knife (as by gouging into the user's hand) during service. The user can also readily grasp the knife during use.

A further aspect of the preferred knife 20 is that the blades 24 and 26 move between their respective open and closed positions by rotation in opposite directions about the pivot pin 32. That is, as shown by the arrow 50 in the view of FIG. 1, the first blade 24 moves from its open to its closed position by a counterclockwise movement. The second blade 24 moves from its open to its closed position by a clockwise movement, arrow 52. Stated alternatively, defining a top 54 and a bottom 56 of the knife, the first blade opens through the top 54 and the second blade opens through the bottom 56.

In describing the details of the construction and operation of the knife 20, it is useful to define two directions perpendicular to the side lock plate 22. A first perpendicular direction 58 extends perpendicularly out of the side lock plate 22 toward the first blade 24 and the first sidepiece 28. A second perpendicular direction 60 extends perpendicularly out of the side lock plate 22 toward the second blade 26 and the second sidepiece 30. A longitudinal axis 62 of the knife extends along its long direction.

Turning to the details of the elements of the knife, the side lock plate 22 is formed with four regions. In the preferred construction, these four regions are integrally connected in a slotted plate structure, but in an alternative approach separate pieces could be fabricated and joined. The side lock plate 22 includes a plate base 64 at the end of the side lock plate 22 remote from the blades 24 and 26 and from the pivot pin 32. A T-shaped plate central region 66 extends from the plate base 64 parallel to the longitudinal axis 62, with the bore 38 through the "T" shaped region 66.

Figure 5:
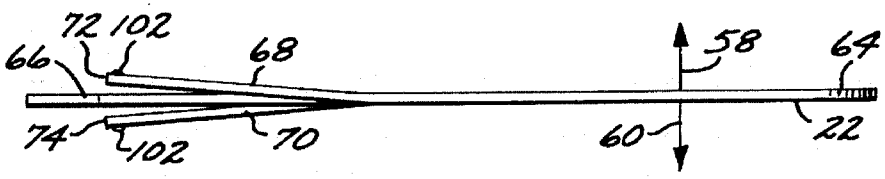
FIG. 5 is a top view of the side lock plate of FIG. 1, as it is manufactured and without any external constraints.

On either side of the central region 66 are fingers 68 and 70. The first finger 68 is bent or sprung in the first perpendicular direction 58, and therefore biased in this direction 58. The second finger 70 is bent or sprung in the second perpendicular direction 60, and therefore biased in this direction 60. The bending of the fingers 68 and 70 is not seen in the exploded view of FIG. 1, as when the knife is assembled the fingers are pressed flat by their contact with the respective adjacent blades 24 and 26. FIG. 5 shows the side lock plate 22 as it is manufactured, with the fingers 68 and 70 in their bent and biassed positions. The extended, bent positions of the two fingers 68 and 70, as shown in FIG. 5, are termed their respective finger locking positions.

The first finger 68 has a first finger locking shoulder 72 thereon at the end of the first finger 68 adjacent to the T cross bar of the central region 66. Similarly, the second finger 70 has a second finger locking shoulder 74 at the end of the second finger 70 adjacent to the T cross bar of the central region 66. The cooperation of these finger locking shoulders 72 and 74 with their respective blades 24 and 26 will be described subsequently.

The first blade 24 has a first blade locking shoulder 76 at the end of the blade remaining within the body 48 of the knife 20, when the first blade 24 is opened. The second blade 26 has a second blade locking shoulder 78 at the end of the blade remaining within the body 48 of the knife 20, when the second blade 26 is opened. The respective blade locking shoulders 76 and 78 are positioned on the blades so as to engage the respective finger locking shoulders 72 and 74, when the respective blades 24 and 26 are opened to their open position, thereby providing the respective blades 24 and 26 with positive open-position locks that prevent the blades 24 and 26 from closing until the locks are released.

Figure 2:
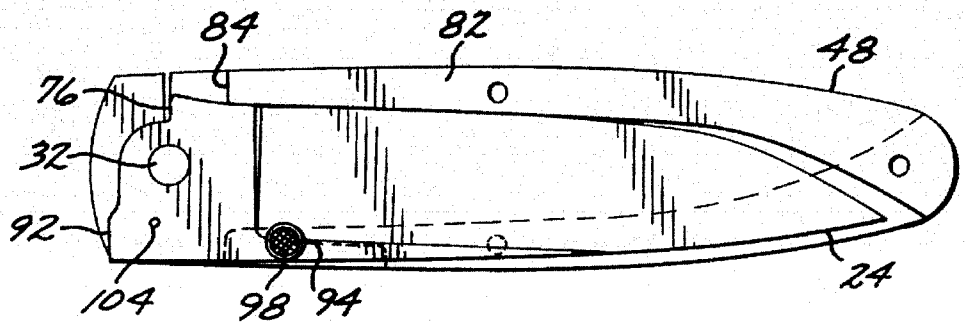
FIG. 2 is a side view of the knife of FIG. 1 showing the first blade in the closed position and with portions of the structure in phantom view.

The operation of the locks can be seen by referring to FIGS. 2–4 and 7–8, which show the operation of the open-position lock for the case of the first blade 24. The operation of the open-position lock for the second blade 26 is similar. In FIG. 2, the blade 24 is in the closed position within the body 48. The side of the blade 24 compresses the first finger 48 from the extended, finger locking position shown in FIG. 5 to the flat position shown in FIG. 1, so that the first finger 48 is coplanar with the central region 66.

Figure 8:
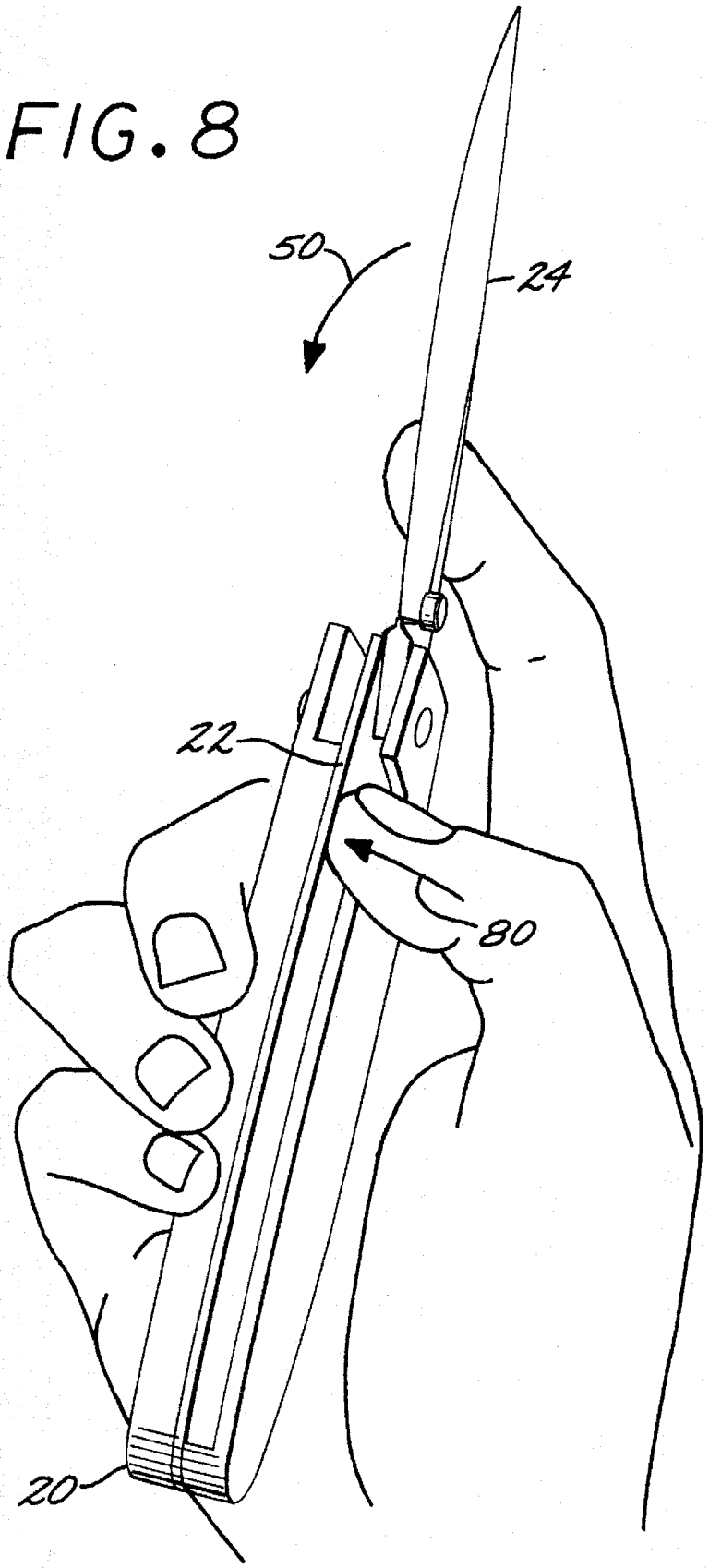
FIG. 8 is a perspective view of the knife of the invention held in a hand during unlocking and closing of one of the blades.

As the blade 24 is opened (by a clockwise rotation progressing as shown in FIG. 6 from the view of FIG. 2 to that of FIG. 3), the inward compressive force on the first finger 48 is released and the first finger 68 springs outwardly in the first perpendicular position 58. When the first blade 24 is in its fully open position shown in FIG. 3, the first finger locking shoulder 72 engages the first blade locking shoulder 76, as may be seen in FIG. 4. The first blade 24 is thereby locked into the fully open position by this positive lock. The first blade cannot be rotated back (counterclockwise) to the closed position until the lock is released. The lock is released when the user manually presses against the side of the first finger 68, as indicated by the arrow 80 in FIG. 4 and as depicted in FIG. 8. The structures which aid in opening and permit easy manual access to the side of the first finger 68 to achieve unlocking of the blade will be described subsequently.

The open position lock just described prevents the blade from closing unless the lock is released. The blade must also be prevented from rotating too far, past the blade open position shown in FIGS. 1 and 3. To provide this blade stop function, the first sidepiece 28 has an inward (toward the side lock plate 22) first sidepiece projection 82 with a first sidepiece stop shoulder 84 thereon. Similarly, the second sidepiece 30 has an inward (toward the side lock plate 22) second sidepiece projection 86 with a second sidepiece stop shoulder 88 thereon. The first and second sidepiece stop shoulders 84 and 86 face toward the end of the knife 20 where the blades 24 and 26 are attached with the pivot pin 32. The cooperation of these stop shoulders 84 and 86 with their respective blades 24 and 26 will be described subsequently.

The first blade 24 has a first blade stop shoulder 90 at the end of the blade remaining within the body 48 of the knife 20, when the first blade 24 is opened. The second blade 26 has a second blade stop shoulder 92 at the end of the blade remaining within the body 48 of the knife 20, when the first second 26 is opened. The respective blade stop shoulders 90 and 92 are positioned on the blades so as to butt against the respective sidepiece stop shoulders 84 and 88, when the respective blades 24 and 26 are opened to their open positions, thereby providing the respective blades 24 and 26 with positive stops that prevent the blades 24 and 26 from rotating past their desired fully open positions when the blades lie parallel to the longitudinal axis 62.

The operation of the stops can be seen by referring to FIGS. 2–9, which show the operation of the stops for the case of the first blade 24. The operation of the stop for the second blade 26 is similar. In FIG. 2, the blade 24 is in the closed position within the body 48. The stops do not come into play.

Figure 3:
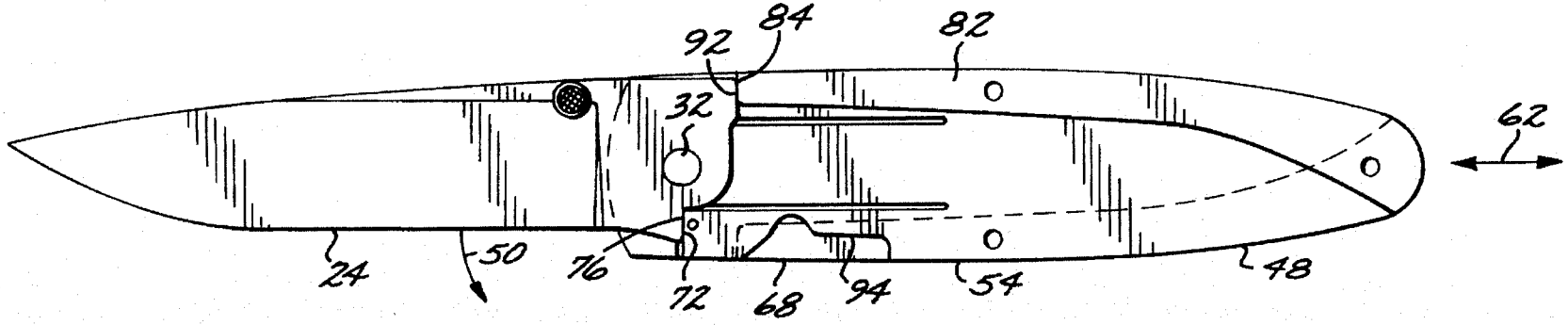
FIG. 3 is a side view of the knife of FIGS. 1 and 2 with the first blade in the open position and with portions of the structure in phantom view.

As the blade 24 is opened (by a clockwise rotation progressing from the view of FIG. 2 to that of FIG. 3) to the point that it is in its fully open position shown in FIG. 3, the first sidepiece stop shoulder 84 butts against the first blade stop shoulder 90. The clockwise rotation of the first blade 24 is thereby stopped so that it cannot be rotated further. In combination with the open position lock described previously, the stop structure rigidly locks the blade 24 so that it cannot rotate in either direction from its fully open position, unless the open position lock is released.

The opening and closing of the knife blades are facilitated by providing a cutout in each of the sidepieces and a cooperating element on the respective blades. Thus, a first sidepiece cutout 94 is formed in the first sidepiece 28 along the edge of the first sidepiece adjacent the knife top 54. Similarly, a second sidepiece cutout 96 is formed in the second sidepiece 30 along the edge of the first sidepiece adjacent the knife bottom 56.

Figure 4:
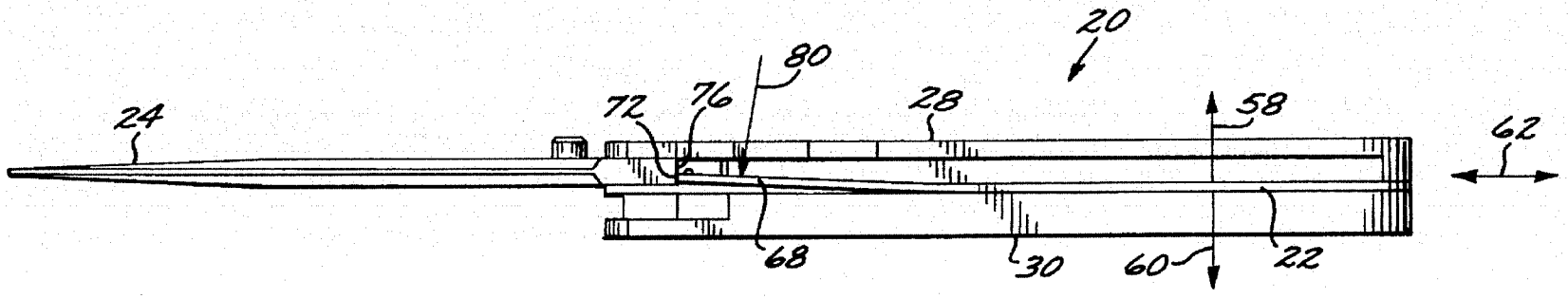
FIG. 4 is a top view of the knife of FIG. 3, with the first blade in the open and locked position and with portions of the structure in phantom view.

As an aid in opening the knife blades 24 and 26, flick projections are formed on the sides of the knife blades. As seen in FIGS. 1 and 4, a first blade flick projection 98 is formed in the first perpendicular direction 58 on the side of the first blade 24 facing the first sidepiece 28. As seen in FIG. 1 in a phantom view, a second blade flick projection 100 is formed in the second perpendicular direction 60 on the side of the second blade 26 facing the second sidepiece 28.

Figure 7:
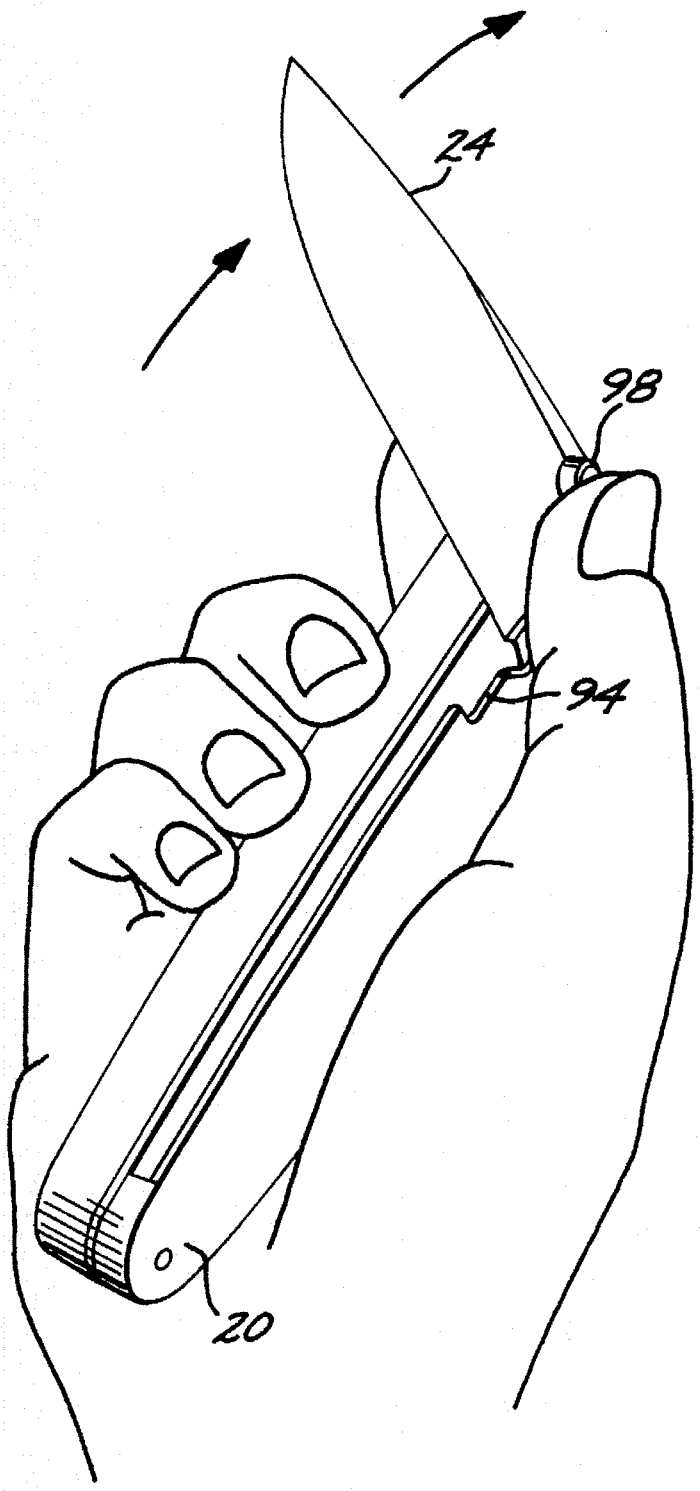
FIG. 7 is a perspective view of the knife of the invention held in a hand during opening of one of the blades.

The use of the flick projections in opening of the blades can be seen by referring to FIGS. 2 and 7, which show the opening operation for the case of the first blade 24. The operation of the stop for the second blade 26 is similar. When the first blade 24 is in the closed position, FIG. 2, the first blade flick projection 98 is received within the first sidepiece cutout 94. The first blade flick projection 98 is preferably made no longer than the thickness of the first sidepiece 28 in the region of the first sidepiece cutout 94, so that it does not project out of the body 48 and provide a possible source of snags when the knife 20 is removed from the pocket of the user. However, because its rounded shape has little likelihood of causing a snag, the first blade flick projection 98 may be made about the same length or even slightly greater in length than the thickness of the first sidepiece 28 without having a significant adverse effect on the smooth-surface, antisnag characteristics of the knife. Making the first blade flick projection 98 slightly longer than the thickness of the first sidepiece 28 may improve the ease of opening the first blade 24 using the flick projection 98.

To open the first blade 24 from the closed position of FIG. 2, the user holds the knife in one hand and applies pressure with the thumb (or one of the fingers, but preferably the thumb) against the first blade flick projection 98 as shown in FIG. 7, and continues that pressure until the first blade rotates to the open position of FIG. 3 and locks at that position in the manner described previously.

The unlocking of the blade open lock is also facilitated by the sidepiece cutout for that blade, as can be seen by referring to FIGS. 3 and 8, which show the manner of releasing the lock for the case of the first blade 24. The releasing of the lock for the second blade 26 is similar. When the first blade 24 is in the open position, a portion of the first finger 68 is accessible to the thumb (preferably) or the finger of the user of the knife through the first sidepiece cutout 84. The user applies pressure to the first finger 68 in the region exposed through the first sidepiece cutout 94, in the direction 80 against the bias force of the first finger 68. Simultaneously, the user rotates the first blade 24 in the counterclockwise direction 50 (of FIGS. 3 and 8), past the point where the first finger locking shoulder 72 engages the first blade locking shoulder 76. From this point onward in the closing of the first blade 24, there is no need to continue to apply pressure to the first finger 68, as the side of the first finger 68 rides over the adjacent side of the first blade 24.

When the blades 24 and 26 are closed, they can be retained in the closed position by frictional force, a spring, or any other operable mechanism. A preferred approach is a ball-detent mechanism. With the ball detent mechanism, a small recess is made in the side of the fingers 68 and 70 that face outwardly toward the respective sides 28 and 30. A steel ball 102, preferably about 0.020 inches in diameter, is placed into each of the recesses during assembly of the knife. Each of the steel balls 102 is captured between its respective finger 68 or 70 and the facing side of the respective blade 24 or 26. As the blades 24 or 26 are opened or closed, the balls 102 act as ball bearing to ensure a smooth pivoting motion. A closed-position retention recess 104 is formed in each of the sides of the respective blades 24 and 26 that face the respective steel balls 102, at a location such that the respective balls 102 roll into the respective recesses 104 when the respective blades reach their desired closed positions. As the ball 102 falls into the recess 104, the finger upon which the ball is supported relaxes outwardly by a small amount. To open the blade from this closed position, a small force must be exerted to force the finger inwardly. The blade is thereby retained in the closed position by this detent mechanism until a small force is exerted to open the blade.

A prototype knife has been constructed according to the preferred embodiment discussed above and depicted in FIGS. 1–5. Experience with the knife validated the various mechanisms and structures discussed herein. When the knife was held in one hand, pressure by the thumb of the user against the blade flick projection moved the blade from the closed position toward the open position as shown in FIG. 7. The pressure applied with a extending and circling motion of the thumb brought the blade to the fully open position where it was stopped and then locked into position. When the blade was to be closed, the thumb was pressed against the side of the first finger 68 through the sidepiece cutout to unlock the blade lock mechanism as shown in FIG. 8, and at the same time the index finger rotated the blade to the closed position where it achieved a weak retention with the detent. During all of these operations, the knife was readily grasped firmly within the palm and remaining fingers of the user. One handed operation, a desirable feature many knife users, is readily obtained.

When the knife was held and opened in the manner just described, the blade rotated away from the hand of the user. To use the other blade, the user closed the first-used blade. The user rotated the entire knife 180 degrees about the longitudinal axis 62 using only the hand holding the knife, so that the other blade opened away from the hand of the user. Then the one-handed opening, locking, unlocking, and closing motions previously described were used, for the other blade.

By this approach, the user of the knife could select the blade to be used and fully operate the knife, entirely with one hand. With a minimal amount of practice to develop coordinated movements, the user could operate the knife with little thought to the mechanics of the operation. The user was free to devote the use of the other hand and most of his or her attention to the use of the knife rather than the operation of the knife.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A folding knife, comprising:

a first blade pivotably mounted to move between a first blade open position and a first blade closed position;

a second blade pivotably mounted to move between a second blade open position and a second blade closed position;

side lock means for permitting independently controllable opening and closing of the first and second blades, the side lock means being positioned between the first blade and the second blade and including first blade side lock means for releasably locking the first blade in a first blade open position, and second blade side lock means for releasably locking the second blade in a second blade open position, wherein the side lock means comprises a single plate slotted along a portion of its length to define a plate central region, a first finger, and a second finger; and a common pivot pin about which the first blade and the second blade pivot.

2. The folding knife of claim 1, wherein the first blade pivots about the common pivot pin from the first blade closed position to the first blade open position in a first pivoting direction, and the second blade pivots about the common pivot pin from the second blade closed position to the second blade open position in a second pivoting direction.

3. The folding knife of claim 1, wherein the first finger is biased toward the first blade and the second finger is biased toward the second blade.

4. A folding knife, comprising:

an elongated knife body having a first end;

a first blade pivotably mounted to the first end of the knife body to move between a first blade open position and a first blade closed position;

a second blade pivotably mounted to the first end of the knife body to move between a second blade open position and a second blade closed position; and a side lock plate positioned between the first blade and the second blade and including a first finger biased toward the first blade, the first finger engaging the first blade when the first blade is in the first blade open position, and a second finger biased toward the second blade, the second finger engaging the second blade when the second blade is in the second blade open position.

5. A folding knife, comprising:

a side lock plate, there being defined for the side lock plate a first perpendicular direction extending outwardly from a first side of the side lock plate and a second perpendicular direction extending outwardly from a second side of the side lock plate, the side lock plate comprising a plate base, a T-shaped plate central region joined to the plate base and coplanar with the plate base, a first finger joined to the plate base and coplanar with the plate base at the point of joining, the first finger being bent along its length in the first perpendicular direction to a first finger locking position and having a first finger locking shoulder thereon at the end remote from the plate base, and a second finger Joined to the plate base and coplanar with the plate base at the point of joining, the second finger being bent along its length in the second perpendicular direction to a second finger locking position and having a second finger locking shoulder thereon at the end remote from the plate base;

a first blade pivotably mounted to the side lock plate adjacent to the first side of the side lock plate to move between a first blade open position and a first blade closed position, the first blade having a first blade locking shoulder that engages the first finger locking shoulder when the blade is in the open position and the first finger is in the first finger locking position, but which is pivotable past the first finger locking shoulder to the first blade closed position when the first finger lies coplanar with the plate central region; and a second blade pivotably mounted to the side lock plate adjacent to the second side of the side lock plate to move between a second blade open position and a second blade closed position, the second blade having a second blade locking shoulder that engages the second finger locking shoulder when the blade is in the open position and the second finger is in the second finger locking position, but which is pivotable past the second finger locking shoulder to the second blade closed position when the second finger lies coplanar with the plate central region.

6. The folding knife of claim 5, wherein the first blade pivots from the first blade closed position to the first blade open position in a first pivoting direction, and the second blade pivots from the second blade closed position to the second blade open position in a second pivoting direction.

7. The folding knife of claim 5, wherein the side lock plate comprises a single plate slotted along a portion of its length to define the plate central region, the first finger, and the second finger.

8. The folding knife of claim 5, further including a first sidepiece overlying the first blade such that the first blade lies between the first sidepiece and the side lock plate.

9. The folding knife of claim 8, further including a first sidepiece cutout in the first sidepiece, and a flick projection on the first blade positioned to register with the first sidepiece cutout when the first blade is in the first blade closed position.

10. The folding knife of claim 8, further including a first sidepiece stop shoulder on the first sidepiece adjacent to the side lock plate, and a first blade stop shoulder positioned to engage the first sidepiece stop shoulder when the first blade is in the first blade open position.

11. The folding knife of claim 8, further including a second sidepiece overlying the second blade such that the second blade lies between the second sidepiece and the side lock plate.

12. The folding knife of claim 11, further including a second sidepiece cutout in the second sidepiece, and a flick projection on the second blade positioned to register with the second sidepiece cutout when the second blade is in the second blade closed position.

13. The folding knife of claim 11, further including a second sidepiece stop shoulder on the second sidepiece adjacent to the side lock plate, and a second blade stop shoulder positioned to engage the second sidepiece stop shoulder when the second blade is in the second blade open position.

14. The folding knife of claim 11, wherein the first sidepiece and the second sidepiece are formed as a single molded sidepiece unit.

15. The folding knife of claim 5, further including a recess on the side of the first finger facing the first blade, a ball received into the side of the first finger facing the first blade, and a closed-position retention recess on the side of the first blade facing the ball, the closed-position retention recess being disposed such that the ball rests within the closed-position retention recess when the first blade is in its closed position.

16. The folding knife of claim 1, further including a flick projection extending laterally outwardly from the first blade.

17. The folding knife of claim 1, further including means for retaining the first blade in the first blade closed position.

18. The folding knife of claim 4, further including a flick projection extending laterally outwardly from the first blade.

19. The folding knife of claim 4, further including means for retaining the first blade in the first blade closed position.

* * * * *